US006634514B2

(12) United States Patent
Ducrot

(10) Patent No.: US 6,634,514 B2
(45) Date of Patent: Oct. 21, 2003

(54) CONTROL MONITORING DEVICE FOR TOWER CRANES

(75) Inventor: Pascal Ducrot, Saint Nizier sous Charlieu (FR)

(73) Assignee: Potain (Societe Anonyme), Ecully (FR)

( * ) Notice: Subject to any disclaimer, the term of this patent is extended or adjusted under 35 U.S.C. 154(b) by 2 days.

(21) Appl. No.: 09/799,720

(22) Filed: Mar. 7, 2001

(65) Prior Publication Data

US 2002/0011457 A1 Jan. 31, 2002

(30) Foreign Application Priority Data

Apr. 28, 2000 (IT) ..... MI2000A0940

(51) Int. Cl.[7] ..... B66C 13/40
(52) U.S. Cl. ..... 212/285; 212/278; 212/286
(58) Field of Search ..... 212/278, 285, 212/286

(56) References Cited

U.S. PATENT DOCUMENTS

| | | | | |
|---|---|---|---|---|
| 3,774,217 A | | 11/1973 | Bonner et al. | |
| 4,752,012 A | * | 6/1988 | Juergens | 212/154 |
| 6,244,015 B1 | * | 6/2001 | Ito et al. | 52/741.01 |
| 2001/0044789 A1 | * | 11/2001 | Widrow et al. | 706/14 |

FOREIGN PATENT DOCUMENTS

| | | | |
|---|---|---|---|
| EP | 0 481 501 A1 | | 4/1991 |
| EP | 0 866 022 A2 | | 9/1998 |
| FR | 2 501 660 | | 9/1982 |
| GB | 2 092 099 | * | 8/1982 |
| JP | 11-106180 | * | 4/1999 |
| RU | 1803379 | * | 3/1993 |

* cited by examiner

*Primary Examiner*—Thomas J. Brahan
(74) *Attorney, Agent, or Firm*—Oliff & Berridge PLC

(57) ABSTRACT

The invention relates to a control monitoring device for tower cranes, in particular for small cranes, with integration of functions, and adapted for radio control. The device comprises, in respect of all the movements of the crane, such as hoisting, rotation, distribution and translation, a monitoring/control electronic unit (2) receiving at its inputs and processing the control signal (4) originating from the radio control box (3), and also receiving signals (5, 8, 9, 13, 15, 17, 19, 21) originating from sensors (6, 8, 11, 18, 20, 22, 23, 24) and from switches (14, 16). The electronic unit (2) delivers start and stop commands (27, 30, 31, 33, 34) at its outputs, while monitoring the action of the speed regulators (28) or other control members (35, 36) assigned to the movements, as well as the action of the crane's safety devices (32).

11 Claims, 1 Drawing Sheet

CONTROL MONITORING DEVICE FOR TOWER CRANES

Figure 1:
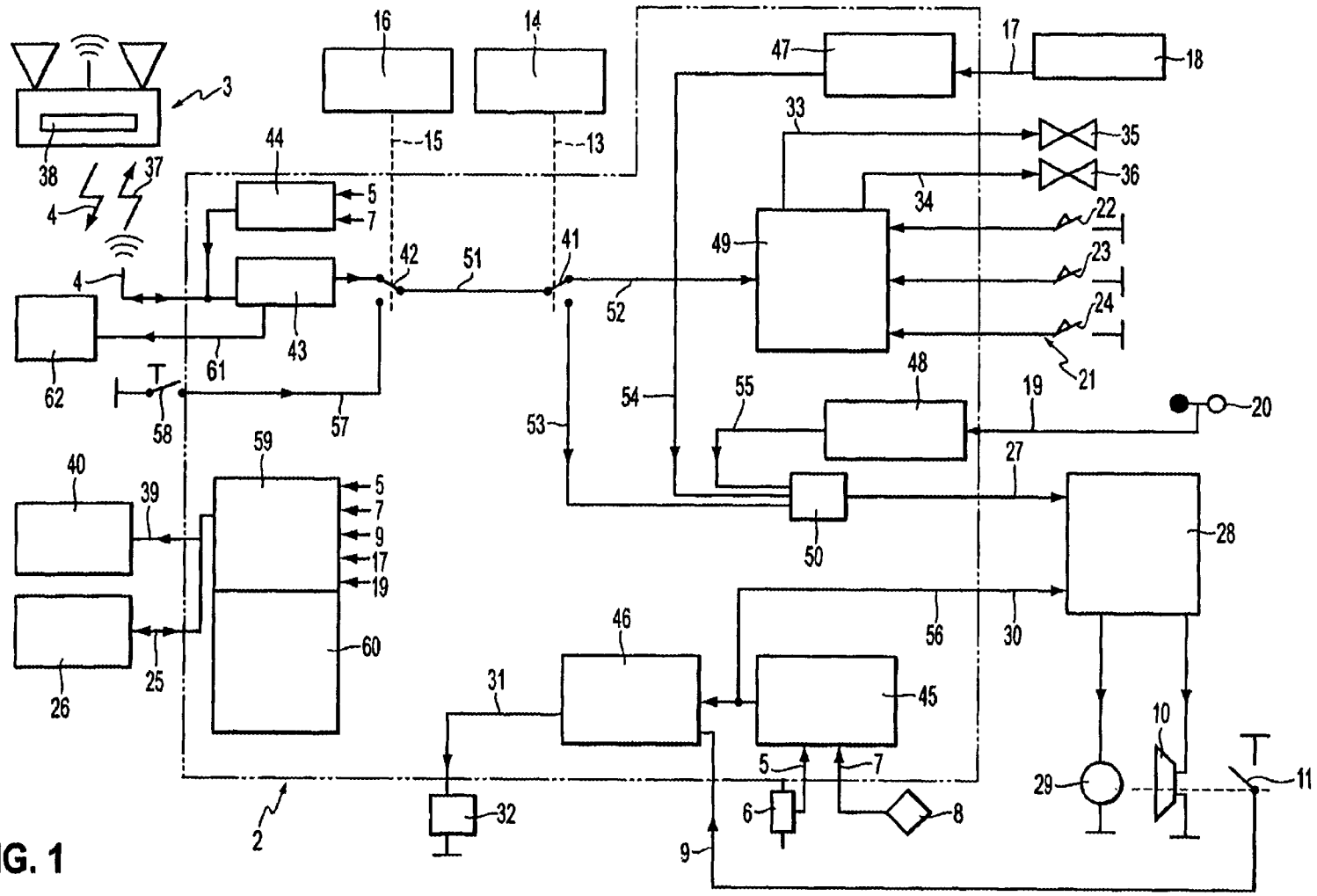

The present invention relates to a monitoring control device for tower cranes, in particular for small cranes, with integration of a set of functions, and adapted for radio control.

In the field of radio controlled mechanisms with speed regulator, for tower cranes, there exist radio control systems composed of a transmitting unit, incorporated into the control facility used by the crane driver, and of a receiving unit situated in the electrical cabinet for controlling the crane, the receiving unit customarily being hooked up to the connector of a conventional cable-based remote control. Systems for managing safety features by redundancy of identical circuits or by redundancy with diversity, based on circuits which may be electromechanical or electronic, are also known in this field.

By contrast, at present there exist no devices which group together and combine, within one and the same unit, the radio control function and the control monitoring function, carried out hitherto by relaying, as well as certain particular functions such as: controls for erecting the crane, in particular for automated erection; emergency controls for the erection and working of the crane; monitoring of the action of the safety devices; crane anti-overturning safety feature; wind speed sensors.

BACKGROUND OF THE INVENTION

In particular, the aforesaid functions do not customarily exist for small cranes, which constitute the main field of application of the present invention, the cost of these functions, when they are separated from one another, being regarded as too high in consideration to the overall price of the crane.

1. Field of the Invention

The present invention is therefore aimed at bringing the cost of these functions, through their integration, to an acceptable level for small cranes, in such a way as to achieve a significant technological advance, endowing them with a technical nature, a diversity of functions and a degree of safety which are comparable with those of larger cranes for an affordable price.

2. Description of the Related Art

More particularly, the aim of the invention is to improve the safety of operation of such cranes, in particular through a simplification of the control circuits which is related to the integrating of the functions into a single electronic unit, with in particular:

a) processing of the safety aspects of the crane, such as:
   - active use of signals from an anemometer and from an inclinometer,
   - monitoring of brake dropout under the action of safety devices,
   - remote control of slewing,
   - use of potentiometric sensors or strain gauge sensors, allowing their permanent monitoring;
b) processing of the reliability of the control system by reducing the number of components and of connections and by customizing the control, for example:
   - elimination of programmable controllers,
   - elimination of relaying or of interfaces between systems,
   - elimination of certain cables, for example, the linking cable between crane and remote control,
   - reduction in the number of unpluggable connections,
   - reduction in the number of sensors,
   - adaptation of the crane to its operating conditions, in particular to its electrical, climatic and mechanical environment;
c) improvement of the maintainability of the crane by:
   - aids to driving, to maintenance, to erection and to operation,
   - adaptation to changes in the environment or to advances in technology,
   - remote interrogation of operating events.

SUMMARY OF THE INVENTION

Accordingly, the subject of the invention is essentially a control monitoring device which comprises, in respect of all the movements of the crane, such as hoisting, rotation, distribution and translation, a monitoring/control electronic unit receiving at its inputs and processing the control signal originating from the radio control box, as well as signals originating from sensors and from switches, and delivering start and stop commands at its outputs, while monitoring the action of the speed regulators or other control members assigned to the movements, as well as the action of the crane's safety devices.

The monitoring/control electronic unit receives and processes in particular signals originating from position sensors and load sensors, a signal originating from a sensor for copying the state of the brake associated with each movement of the crane, a signal originating from a sensor of horizontality of a part of the crane, of the inclinometer kind, and a signal originating from an anemometer. The monitoring/control electronic unit can furthermore receive and process signals originating from a normal/emergency start switch.

As regards the output signals, the monitoring/control electronic unit delivers in particular a monitored start or stop command to the speed regulators, an instantaneous stop command sent to the same speed regulators, and a signal directed to a general cutout actuator.

In an advantageous embodiment, the monitoring/control electronic unit furthermore receives and processes signals originating from a normal/erection start switch, as well as signals related to the configuration of the crane during erection, and it comprises a sequencer receiving these signals and delivering signals for controlling actuators, such as rams, for the folding/unfolding of the crane in a continuous sequence.

The monitoring/control electronic unit can also deliver, by radio, information corresponding to the input signals processed, which information is transmitted to means for aiding driving, in particular in the form of an indicator placed on the radio control box.

The same monitoring/control electronic unit can furthermore deliver a signal for slewing the crane, on the basis of a slewing control signal emitted by the radio control box.

As regards the internal structure of the monitoring/control electronic unit, the latter comprises, in a particular embodiment:

- a decoder and an encoder serving as interfaces for the bi-directional radio link with the radio control box,
- the contacts of the normal/emergency and working/erection start switches,
- a comparator, in particular a multiplier comparator with thresholds, receiving and processing the signals originating from the position sensors and load sensors, a comparator, in particular a filter comparator with fixed threshold, receiving and processing the signal originating from the horizontality sensor, a comparator, in particular a filter comparator with adjustable thresholds, receiving and processing the signal originating from the anemometer, a timeout circuit, receiving the signal originating from the sensor for copying the state of the brake, and having its output linked to the general cutout actuator, the aforesaid sequencer delivering the signals for controlling the actuators for the folding/unfolding of the crane, a logic circuit, emitting the monitored start or stop command sent to the speed regulator as a function of the position of the working/erection switch and of the output signals from the comparators which receive the signals from the horizontality sensor and from the anemometer.

Preferably, the monitoring/control electronic unit furthermore comprises at least one memory for data and for programs, which receives, processes and stores the position signals, the load signals, the signals from the inclinometer and the anemometer, as well as the signal for copying the state of the brake, the memory or memories being interrogatable from terminals, such as operator terminal or remote terminal.

The device according to the invention can furthermore perform a zone limitation action, by means of the comparator/multiplier with thresholds receiving and processing the signals originating from the position sensors, and as a function of the parameters in memory, with emission of an immediate stop command directed to the regulator.

Finally, the electronic unit can comprise an input for downloading updating information from a remote terminal, to the memory or memories.

Anyhow, the invention will be better understood with the aid of the description which follows with reference to the single figure of the appended diagrammatic drawing representing, by way of nonlimiting example, a form of execution of this control monitoring device for tower cranes.

The device, represented in the form of a schematic diagram, chiefly comprises a monitoring/control electronic unit, designated as a whole by the label 2, operating on the basis of electrical signals of low level, in particular in conjunction with a radio control box 3 and with various sensors.

The electronic unit 2 thus receives, at its inputs, a control signal 4 originating from the box of the radio control 3, and also:

analog signals 5 originating from position sensors, designated overall by 6, in particular potentiometer sensors;

a signal 7 originating from a load sensor 8, in particular a strain gauge sensor;

a signal 9 for copying the state (braking or declutching) of the brake 10, originating from a sensor 11 situated for example at the level of the brake 10, which is a power outage type electromechanical brake;

a signal 13 originating from a working/erection switch 14;

a signal 15 originating from a normal/emergency start switch 16, usable both for the working and for the erection of the crane;

a signal 17 originating from a sensor 18 of horizontality of the chassis of the crane (inclinometer);

a signal 19 originating from an anemometer 20;

signals 21 related to the configuration of the crane during erection, and emanating for example from sensors 23, 24 of unfolding of the mast and of position of unfolding of the jib (for example at a given angle, such as 20°);

information 25 for updating values of the internal circuits of the electronic unit 2, from a remotely situated terminal 26.

The electronic unit 2 delivers, at its outputs, various signals which are:

a monitored start or stop command 27, sent to a speed regulator 28 which controls the electric motor 29 with which the aforesaid brake 10 is associated;

an immediate stop command 30 sent to the speed regulator 28;

a signal 31 directed to a general cutout actuator 32;

control signals 33, 34 directed to electrovalves 35, 36 which, themselves, control folding/unfolding rams, respectively for the jib and for the mast of the crane;

information 37 transmitted by radio to devices for aiding the driving of the crane, taking in particular the form of an indicator 38 placed on the box of the radio control 3;

a slewing control signal 61;

other information 39 directed to devices for aiding maintenance, for aiding erection and for aiding operation, which are situated at the level of an operator terminal 40.

The electronic unit 2 itself ensures the processing of the signals, both in respect of their reception and in respect of their transmission, and it also records events which may be the operating cycles of the crane itself or external events. Accordingly, the electronic unit 2 comprises in particular:

the respective inverting contacts 41 and 42 of the working/erection switch 14 and of the normal/emergency start switch 16;

a decoder 43 and an encoder 44, inputs serving as interfaces for the radio link with the transmitter of the radio control box 3;

a comparator/multiplier with thresholds 45, receiving the signals 5 and 7 originating respectively from the position sensors 6 and from the load sensor 8;

a timeout circuit 46 whose inputs are linked to the comparator 45 and to the sensor 11 for copying the state of the brake 10, and whose output is linked to the general cutout actuator 32;

a comparator/filter with fixed threshold 47, receiving the signal 17 from the inclinometer 18;

a comparator/filter with adjustable thresholds 48, receiving the signal 19 from the anemometer 20;

a sequencer 49, receiving at its inputs the signals 21 related to the configuration of the crane, and transmitting at its outputs the control signals 33, 34 for the electrovalves 35, 36;

an "AND" logic gate 50, with three inputs (specified hereinbelow), the output of which delivers the monitored start or stop command 27 sent to the speed regulator 28;

a link 51 between the two inverting contacts 41 and 42, as well as the decoder 43;

a link 52 between the inverting contact 41 and the sequencer 49;

a link 53 between the inverting contact 41 and an input of the "AND" gate 50;

a link 54 between the comparator 47 and another input of the "AND" gate 50;

a link 55 between the comparator 48 and the last input of the "AND"gate 44;

a link 56 between the comparator 45 and the speed regulator 28, for the transmission of the immediate stop command 30.

a last link 57 between the inverting contact 42 and an emergency start control 58, with pushbutton;

a memory for data 59;

a memory for programs 60.

Each movement of the crane, such as: hoisting, rotation, distribution or translation, utilizes parts of a monitoring/control unit 2 similar to the one described above, the example detailed here relating more particularly to the hoisting movement.

The manner of operation of the device described above is set up as follows, for the various functions integrated into this device:

Control of a Movement by the Radio Control 3:

The radio control 3 transmits a radio signal 4, which is received by the device and transformed, by the decoder 43, into a start command 27 forwarded by way of the "AND" gate 50 to the speed regulator 28, which supplies the motor 29 and the brake 10. The motor 29 drives the corresponding mechanism (for example for the hoisting movement) and one of the position sensors 6, according to the movement commanded, delivers the signal 5.

Control of the Stoppage of the Movement:

The signal 4, transmitted by the radio control 3, is removed. As a consequence, the speed regulator 28 no longer receives any start command 22, thus causing a monitored stoppage of the movement, the regulator 28 ceasing to supply the motor 29 and the brake 10 which, being a power outage type brake, then halts the movement.

Action of a Movement Limiter or Load Limiter:

The signal 5 or 7, originating from a position sensor 6 or from the load sensor 8, is fed into the comparator/multiplier with thresholds 45 which produces, when the threshold is attained, an immediate stop command 30 sent to the regulator 28 and, simultaneously, starts up the timer circuit 46. As a consequence:

the regulator 28 ceases to supply the motor 29 and the brake 10;

the sensor 11 delivers the signal 9 for copying the state of the brake 10;

normally, this signal 9 stops the timeout circuit 46 before the time set for this circuit 46 has completely elapsed;

in the absence of the signal 9, and if the time set for the circuit 46 has elapsed, this circuit 46 emits the signal 31, directed to the general cutout actuator 32, which then causes the general stoppage of the crane.

Control of the Emergency Start:

The operator toggles the switch 16 into its emergency start position, this having the effect of activating the emergency start control 58, and of deactivating the signal 4 originating from the box of the radio control 3. The emergency start control 58 is then used, by action on its pushbutton. The signal emitted by this emergency start control 58 is forwarded by way of the "AND" gate 50 and generates a start command 27 for the regulator 28. The manner of operation is then similar to the normal manner of operation, explained at the beginning of the present description of the manner of operation.

Erection Controls:

the working/erection switch 14 is toggled, by the operator, into the erection position, this having the effect of steering the control signal 4, originating from the radio control 3, or the signal emanating from the emergency start control 58, to the sequencer 49.

The sequencer 49 respectively controls the electrovalves 35, 36 for folding/unfolding the jib and the mast, via the signals 33, 34, doing so alternately as a function of the signals 21 which represent the position of the jib and of the mast. Folding or unfolding is thus performed as a continuous sequence.

Slewing:

By pressing a button of the box of the radio control 3, the operator sends a particular control signal received by the decoder 43, which then emits the slewing signal 61, causing the action of the slewing device 62 of the crane.

Actions Controlled on the Basis of the Inclinometer and of the Anemometer:

The signal 17 emanating from the inclinometer 18 is fed to the comparator/filter with fixed threshold 47. The signal 19 emanating from the anemometer 20 is fed to the comparator/filter with adjustable thresholds 48. The output signals from these two comparators 47 and 48 are received at the corresponding inputs of the "AND" gate 50, which enables the monitored start or stop command 27 sent to the speed regulator 28, or disables this command should there be an excessive inclination of the crane or overly strong wind.

"Zone Limitation" Action:

The position sensors 6 deliver the signals 5 which are fed to the comparator/multiplier with thresholds 45. This comparator 45 delivers, as a function of the parameters in memory, the immediate stop command 30 directed to the regulator 28.

Driving Aid Function:

The respective position and load signals 5 and 7 are received and processed by the encoder 44, which transmits the information 37 by radio to the indicator 38 of the radio control box 3.

Function for Aiding Operation and Maintenance:

The position signal 5, the load signal 7, and the signal 9 for copying the state of the brake 10 and the anemometer signal 19 are also received, processed and stored in the data memory 59 and the programs memory 60, which memories may be interrogated by way of the operator terminal 40 or of the remote terminal 26.

Updating of the Programs:

The signal 25, emanating from the remote terminal 26, makes it possible to update the data memory 59 and the programs memory 60.

As goes without saying, the invention is not limited to the single form of execution of this control monitoring device for tower cranes which has been described hereinabove, by way of example; on the contrary it encompasses all variants of embodiment and of application thereof complying with the same principle. In particular, the various functions described hereinabove are not necessarily all amalgamated and may be grouped together according to any combination.

What is claimed is:

1. A control monitoring device for a crane, the device integrating various functions, and adapted for radio control, comprising: in respect of all the movements of the crane, including hoisting, rotation, distribution and translation, a monitoring/control electronic unit receiving at its inputs and processing a control signal originating from a radio control box, as well as a plurality of other signals originating from a plurality of sensors and from at least one switch, and delivering start and stop commands at its outputs, while monitoring the action of at least one of speed regulators and other control members assigned to the movements, as well as the action of safety devices of the crane.

2. The device as claimed in claim 1, wherein the monitoring/control electronic unit receives and processes signals originating from at least one position sensor and at least one load sensor, a signal originating from a sensor for determining a state of a brake associated with each movement of the crane, a signal originating from an inclinometer-type sensor of horizontality of a part of the crane, and a signal originating from an anemometer.

3. The device as claimed in claim 1, wherein the monitoring/control electronic unit receives and processes signals originating from a normal/emergency start switch.

4. The device as claimed in claim 1, wherein the monitoring/control electronic unit delivers a monitored start or stop command to the speed regulators, an instantaneous stop command sent to said speed regulators, and a signal directed to a general cutout actuator.

5. The device as claimed in claim 1, wherein, the monitoring/control electronic unit receives and processes signals originating from a normal/erection start switch, as well as signals related to a configuration of the crane during erection, and comprises a sequencer receiving the signals originating from the normal/erection start switch and the signals related to configuration of the crane during erection and delivering signals for controlling actuators for folding/unfolding of the crane in a continuous sequence.

6. The device as claimed in claim 1, wherein the monitoring/control electronic unit delivers, by radio, information corresponding to input signals processed, which information is transmitted to means for aiding driving, where said means for aiding driving comprises an indicator placed on the radio control box.

7. The device as claimed in claim 1, wherein the monitoring/control electronic unit delivers a signal for slewing the crane, on the basis of a slewing control signal emitted by the radio control box.

8. The device as claimed in claim 1, characterized in that the monitoring/control electronic unit comprises:

a decoder and an encoder serving as interfaces for a bi-directional radio link with the radio control box, contacts of normal/emergency and working/erection start switches, a first comparator, comprising a multiplier comparator with thresholds, receiving and processing signals originating from the at least one position sensor and the at least one load sensor, a second comparator, comprising a filter comparator with a fixed threshold, receiving and processing the signal originating from the horizontality sensor, a third comparator, comprising a filter comparator with adjustable thresholds, receiving and processing the signal originating from the anemometer, a timeout circuit, receiving the signal originating from the sensor for determining the state of the brake, and having its output linked to a general cutout actuator, the aforesaid sequencer delivering the signals for controlling the actuators for folding/unfolding of the crane, a logic circuit emitting the monitored start or stop command sent to the speed regulators as a function of the position of the normal/erection start switch and of output signals from the first, second and third comparators which receive the signals from the horizontality sensor and from the anemometer.

9. The device as claimed in claim 8, wherein the monitoring/control electronic unit further comprises at least one memory for data for programs, which receives, processes and stores the signals originating from the at least one position sensor, the signal originating from the at least one load sensor, the signals originating from the inclinometer-type sensor of horizontality and the anemometer, as well as the signal for determining the state of the brake, the at least one memory being interrogatable from terminals, including an operator terminal and at least one remote terminal.

10. The device as claimed in claim 9, wherein said monitoring/control unit performs a zone limitation action, by means of the comparator/multiplier with thresholds receiving and processing the signal originating from the at least one position sensor, and as a function of the parameters in memory, with emission of an immediate stop command directed to the speed regulators.

11. The device as claimed in claim 9, wherein the electronic unit comprises an input for downloading updating information from a remote terminal, to the at least one memory.

* * * * *